United States Patent [19]

Greenberger

[11] 4,217,713

[45] Aug. 19, 1980

[54] SLIDABLE WINDOW SIGN

[75] Inventor: William Greenberger, White Plains, N.Y.

[73] Assignee: The Hopp Press Incorporated, New York, N.Y.

[21] Appl. No.: 3,095

[22] Filed: Jan. 12, 1979

[51] Int. Cl.[3] ..... G09F 7/10; G09F 19/02

[52] U.S. Cl. ..... 40/488; 40/18; 40/491; 40/611

[58] Field of Search ..... 40/488, 490, 491, 17, 40/18, 611, 594

[56] References Cited

U.S. PATENT DOCUMENTS

| | | | |
|---|---|---|---|
| 564,930 | 7/1896 | Hopkins | 40/488 |
| 2,603,899 | 7/1952 | Leander | 40/594 |
| 3,110,119 | 11/1963 | Reiner | 40/17 |
| 3,748,767 | 7/1973 | Giesecke | 40/491 |
| 3,769,727 | 11/1973 | Kent | 40/488 |
| 3,914,890 | 10/1975 | Behlen | 40/597 |
| 3,991,495 | 11/1976 | Wilson | 40/594 X |

FOREIGN PATENT DOCUMENTS

| | | | |
|---|---|---|---|
| 206913 | 11/1923 | United Kingdom | 40/488 |

*Primary Examiner*—John F. Pitrelli

*Attorney, Agent, or Firm*—Kane, Dalsimer, Kane, Sullivan and Kurucz

[57] ABSTRACT

A slidable window sign is disclosed having a front panel adapted for securement to a window, a back panel attached to the front panel, and a slidable member positioned between the front and back panels. The front panel may contain indicia for viewing through the window without the risk of soiling through use. The slidable member may also include indicia and at least one protrusion thereon to allow vertical mounting without slippage. Foldable ends on the slidable member prevent it from being separated from the panels under normal uses. The ends may be unfolded to form a coplanar relation with the body of the member for purposes of removal.

2 Claims, 6 Drawing Figures

Fig.3
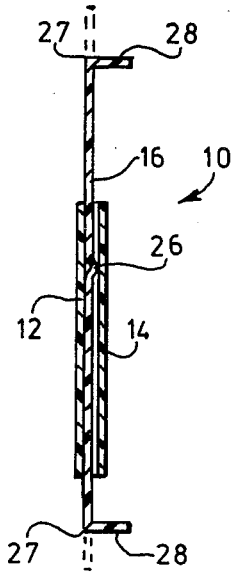
Fig.1
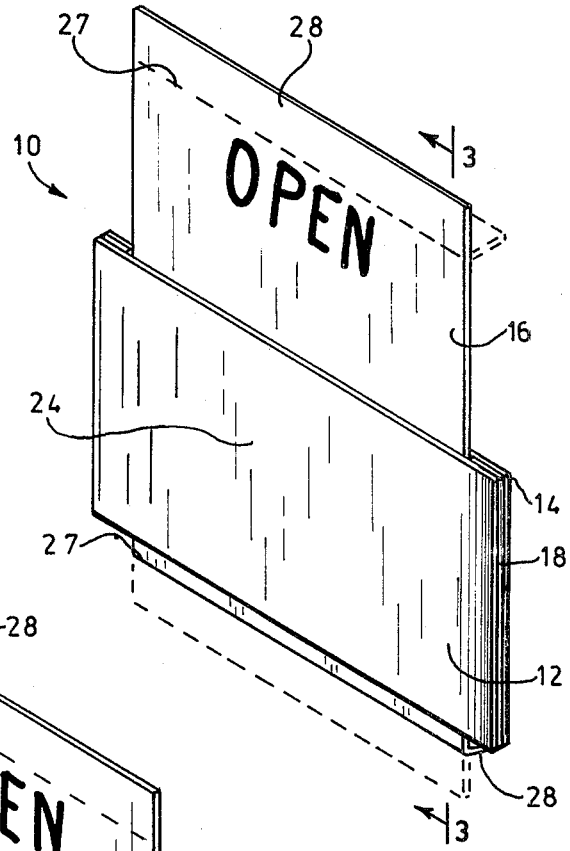
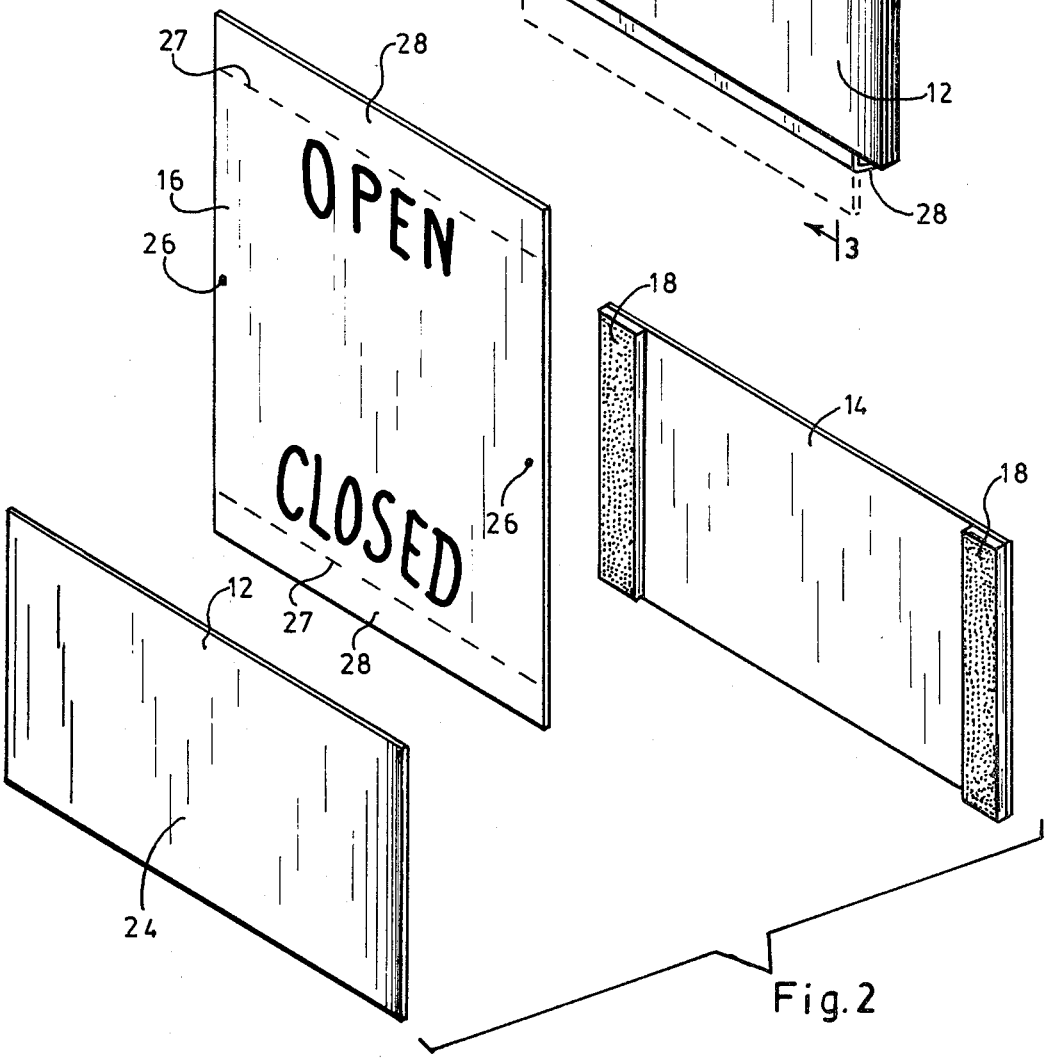
Fig.2

Fig.4
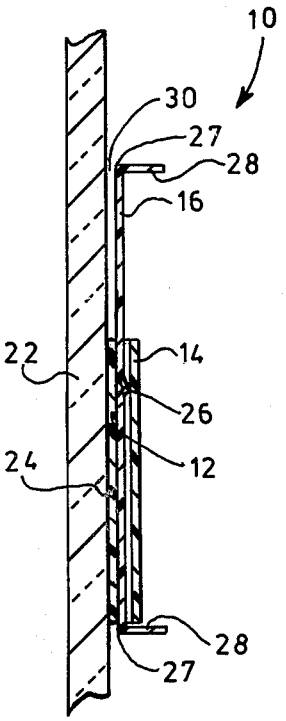
Fig.6
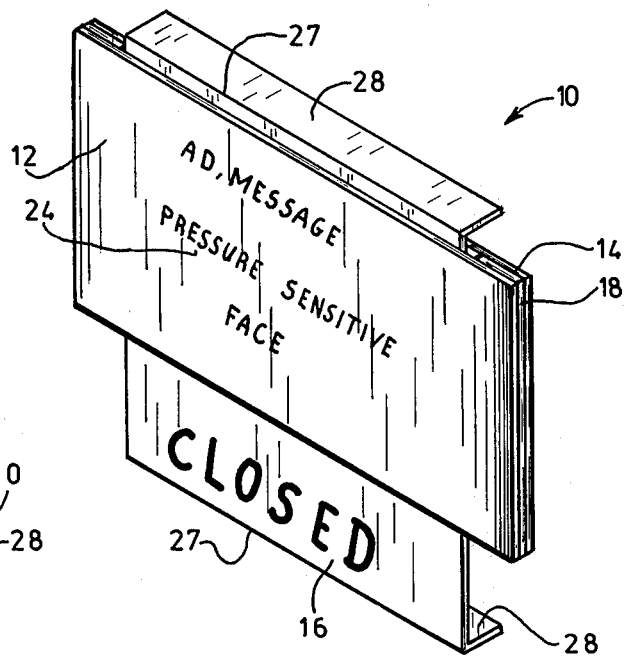
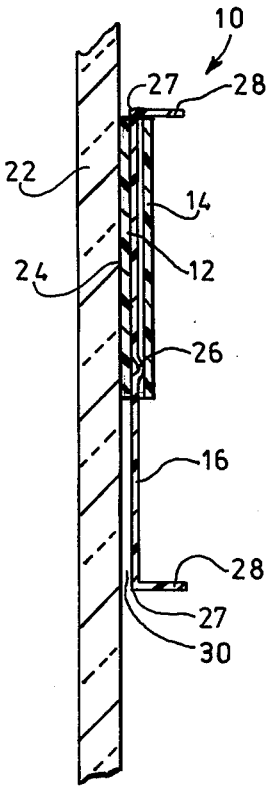
Fig.5

SLIDABLE WINDOW SIGN

BACKGROUND OF THE INVENTION

The field of the invention concerns slidable signs adapted for attachment to windows.

Many businesses find it advantageous to utilize slidable signs on the windows of their establishments. They are commonly attached to the inside surfaces of glass doors and may indicate, for example, whether the business is open or closed, out to lunch, or other information. A slidable member is positioned in one location to convey one message and in another location to convey a second message. Advertising material is also usually included on the sign, and may be read regardless of the position of the slidable member. An example of a slidable window sign which is known to the art is disclosed in U.S. Pat. No. 3,769,727.

Although slidable signs have been successfully employed for most purposes, there has been a problem in that the advertising material or other indicia, which is to be continuously displayed to the public, has a tendency to become soiled if it is constantly scraped along a window surface. Its appearance deteriorates and the sign must be replaced.

Furthermore, the construction of existing signs requires a space between all reading material and the window. Window washing water and other soil can become trapped in the space and is practically impossible to remove. In addition, unsightly rubber spacing strips must be provided which impart an improvised appearance to the display.

SUMMARY OF THE INVENTION

It is an object of the invention to provide a slidable window sign capable of displaying information to the public.

It is another object of the invention to provide a slidable sign having an indicia-bearing portion which will not be subject to soiling and deterioration after extended use.

Still another object of the invention is to provide a sliding member having at least one protrusion to prevent slippage.

Still another object of the invention is to provide a fully pressure-sensitive display portion of the sign which demands a much smaller area of the window reserved to attach the sign and which obviates the need for rubber spacing strips which are unsightly and detracting in appearance.

A still further object of the invention also is to provide a sign, the interchangeable portion of which can be added or removed at will after the sign is installed without impairing its promotional appearance or value.

With these and other objects in mind, a slidable window sign is provided having a front panel, a rear panel attached to the front panel such that a slidable member may be positioned therebetween, and means for securing the front panel to a window or the like. The front and rear panels ae preferably of equal size and of rectangular configuration. They are attached to each other along two parallel peripheral edges.

The slidable member may also be generally rectangular in shape and include foldable opposing end portions designed to contact the panel edges which define an opening between the panels for insertion at the slidable member. To remove the slidable member, the end portions are folded to form a coplanar relation with the body of said member.

The slidable member preferably includes at least one protrusion to prevent it from slipping when vertically mounted between the panels. The protrusions also limit the area of contact between one of the panels and said member, and may thereby serve to minimize the scraping between these two elements.

Because the front panel is completely secured to the window, it is stationary with respect to the slidable member. Any advertising on the face of this panel will accordingly be subject to no scraping or scuffing. Since there is no space between the panel and the window, water cannot become trapped therebetween.

BRIEF DESCRIPTION OF THE DRAWINGS

FIG. 1 is a perspective view of the slidable window sign;

FIG. 2 is an exploded view of the sign shown in FIG. 1;

FIG. 3 is sectional view taken along the plane of line 3—3 of FIG. 1;

FIG. 4 is a sectional view of the window sign secured to a window;

FIG. 5 is similar to FIG. 4 and shows the slidable member in a different position;

FIG. 6 is similar to FIG. 1 in which the slidable member is in a different position.

DESCRIPTION OF THE INVENTION

Referring to the Figures, a slidable window sign 10 is provided having a rectangular front panel 12, a similarly shaped rear panel 14, and a generally rectangular slidable member 16 in a space between the panels. A pair of adhesive-backed strips 18 are provided for attaching the two panels. Front panel 12, which attaches to a window 22, is pressure-sensitive over its entire front surface 24 so that it provides one hundred percent adhesion and no opportunity for soiling or water entry. Both the slidable member and the panels may be fabricated from plastic, metal, or other appropriate material. Indicia may be provided on the surfaces of these elements, particularly the front and rear surfaces of the sliding member, the front surface 24 of the front panel and the rear surface of the rear panel. If the front and rear panels are either opaque or have information provided thereon, they will occlude about one half of the slidable member at all times. The slidable member may accordingly be used to indicate whether a business is open or closed as in FIGS. 1 and 6 or convey other similar messages. Alternatively, an advertisement or other notice may be applied directly to a window and the sign 10 affixed with its front panel 12 behind it. This could also serve to occlude a desired portion of the slidable member.

A plurality of protrusions 26 are provided near the middle of the slidable member to allow the sign to be mounted vertically on a window as shown in FIGS. 4 and 5. There will be no slippage from the position shown in FIG. 4 to that of FIG. 5 as the protrusions insure sufficient frictional contact to overcome the force of gravity, yet allow one to easily slide the slidable member to the desired position. Scored top and bottom lines 27 define end portions 28 which can be folded back at a 90° angle to prevent the slidable member from being separated from the panels. They also insure that the sign is in proper position to display the desired information as one end portion should always be in contact with the edges of the panels which define the opening for insertion of the slidable member. The scored lines are preferably located about one-quarter inch from the edges of the slidable member.

The sign is utilized as shown in FIGS. 4–5. The adhesive front surface 24 secures it to a window 22. Advertising material is attached either to the window or the front surface 24 of the front panel 12. The slidable member 16 is positioned where desired, and frictional contact between it and the panels 12, 14 maintain this position. Since the informational material carried on the front panel does not move, it will not tend to deteriorate or soil. There is also a small space 30 between the slidable member 16 and the window 2 so that it also will not be subject to excessive scraping or scuffing.

The slidable member may be removed after the sign is affixed to the window if the message thereon is no longer pertinent or if it has become soiled and needs replacement. This is accomplished by holding an end portion 28 along a scored line 27 so that it is coplanar with the body of the slidable member. The member may then be pulled out from between the panels.

Thus the aforenoted objects of the invention are most effectively attained. It will be appreciated by those skilled in the art that modifications can be made in the disclosed apparatus without materially departing from the spirit of the invention. The scope of the invention should accordingly be determined by reference to the appended claims.

What is claimed is:

1. A sign adapted for attachment to a window, comprising:

a first panel having a front surface and a rear surface, the front surface adapted for attachment to a window said front surface of said first panel is pressure-sensitive over its entire area such that when said surface is attached to a window, water is substantially precluded from entering between said front surface and said window;

a second panel attached to the first panel in such a manner that a space is provided between the two panels, and a slidable member positioned within said space between the panels and slidable therein said first and second panels are substantially rectangular and substantially the same size, the slidable member being substantially rectangular and having a pair of opposing foldable ends adapted to contact opposing edges of said panels when in a folded position, said slidable member being removable from between said panels when at least one of said ends is in an unfolded position, said slidable member includes at least one protrusion for providing frictional contact with at least one panel.

2. A sign as described in claim 1 wherein said panels and said slidable member are of a plastic material, said slidable member including scored lines near opposing edges defining said foldable end portions.

* * * * *